US007413364B2

(12) United States Patent
Grant

(10) Patent No.: US 7,413,364 B2
(45) Date of Patent: Aug. 19, 2008

(54) FASTENERS FOR ALBUMS

(76) Inventor: Stephen Grant, 30 Church Street, Toorak, Victoria 3142 (AU)

( * ) Notice: Subject to any disclaimer, the term of this patent is extended or adjusted under 35 U.S.C. 154(b) by 817 days.

(21) Appl. No.: 10/896,740

(22) Filed: Jul. 21, 2004

(65) Prior Publication Data

US 2005/0151366 A1 Jul. 14, 2005

(30) Foreign Application Priority Data

Jan. 14, 2004 (AU) ..... 2004900156
Apr. 22, 2004 (AU) ..... 2004902150

(51) Int. Cl.
*B42F 3/00* (2006.01)
*B42D 1/00* (2006.01)

(52) U.S. Cl. ..... 402/60; 402/68; 402/64; 402/8; 281/15.1; 281/21.1

(58) Field of Classification Search ..... 402/60, 402/68, 64, 63, 62, 8; 281/15.1, 21.1
See application file for complete search history.

(56) References Cited

U.S. PATENT DOCUMENTS 2,524,688 A * 10/1950 Wendt ..... 402/17
3,080,562 A * 3/1963 Potts et al. ..... 402/17
3,263,689 A * 8/1966 Lindgren et al. ..... 402/17
3,628,877 A * 12/1971 Barnes, Jr. ..... 402/17

FOREIGN PATENT DOCUMENTS

| | | |
|---|---|---|
| GB | 2257094 | 1/1993 |
| JP | 57093199 | 6/1982 |

* cited by examiner

*Primary Examiner*—Willmon Fridie
(74) *Attorney, Agent, or Firm*—Knobbe Martens Olson & Bear LLP

(57) ABSTRACT

A releasable fastener for an album to permit insertion and removal of pages between the covers. The fastener has a pair of strap anchors each attached to one of the two covers and a strap passing between the anchors via aligned apertures in the covers and album pages. Each strap anchor is in the form of a channel in which the strap is a snap fit so that the strap is releasably locked into the channel and is restrained from longitudinal displacement by inter-engaging formations on the base of the channel and the opposing surface of the strap.

14 Claims, 10 Drawing Sheets

FASTENERS FOR ALBUMS

BACKGROUND OF THE INVENTION

1. Field of the Invention

The present invention relates to fasteners for albums such as photographic albums and scrapbooks where it is the required to add or replace album pages.

2. Description of the Prior Art

Certain types of photographic albums and scrapbooks are designed for easy expansion by the insertion of additional pages and pages may also be removable from the album as required. Conventially, such an album consists of separate front and rear covers and separate album pages between the covers. The album is held an assembled state by releasable fasteners, each consisting of a male and female screw inserted from the front and the back of the album, the female screw consisting of a screw head and an internally threaded shack and the male screw consisting of a head and an externally threaded shank, which engages within the internally threaded shank of the female screw. The two screws, when assembled, provide a fastening of variable length which can be adjusted within predetermined limits to suit the number of pages within the album. To permit replacement or insertion of pages, one or other of the screws is removed to permit removal of the front or the back cover and possibly some of the album pages at the front or back while the other screw remains in position to retain the remainder of the album pages in alignment. This screw-type fastening system has been in use for many years but is not particularly convenient to use as it can be quite difficult to align the male and female screws while maintaining alignment of the pages particularly when adding album sheets to increase the size of the album.

SUMMARY OF THE INVENTION

According to the present invention there is provided a releasable fastener for an album comprising front and back covers and removable pages between the covers, the fastener having a pair of strap anchors, one adapted to be attached to the front cover and the other to the back cover, a strap adapted to pass through aligned apertures in the covers and album pages from the strap anchor at the front to the strap anchor at the back, and means for providing a releasable connection between the strap and each of the strap anchors to enable insertion and removal of pages at the front and back of the album, the releasable connection permitting adjustment of the effective length of the strap between the anchors to accommodate a variable thickness of the album.

In a particularly preferred form of the invention, each strap anchor is in the form of a channel in which the strap is a snap lock to be releasably locked therein against displacement. Preferably the strap is snap-locked into the channel by snapping engagement beneath locking lips at an open side of the channel facing the base of the channel, and the base of the channel and opposing surface of the strap have formations which are engaged to prevent longitudinal displacement of the strap within the channel when its in its engaged position beneath the lips. These inter-engaging formations on the base of the channel and surface of the strap may consist of closely-spaced lateral ribs which are preferably of saw-tooth profile in cross-section, although other types of formations which co-operate to prevent longitudinal displacement of the strap could alternatively be used.

Preferably there are two or more opposed pairs of locking lips arranged at spaced intervals along the channel. This provides a more positive locking system than the incorporation of a single, long, locking lip extending along each edge of the channel at the open side thereof.

Preferably the strap enters into the channel via an aperture in the base of the channel and that aperture is bordered by a projection adapted to extend into the adjacent hole in the cover to ensure correct location between the strap anchor and the cover.

The present invention also provides an album having at least two fasteners as defined above mounted along the spine part of the album, the strap anchors of each fasteners being attached to the respective covers of the album.

In one practical form, the strap anchors can be adhesively attached to the respective covers, for example by double sided adhesive tape.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
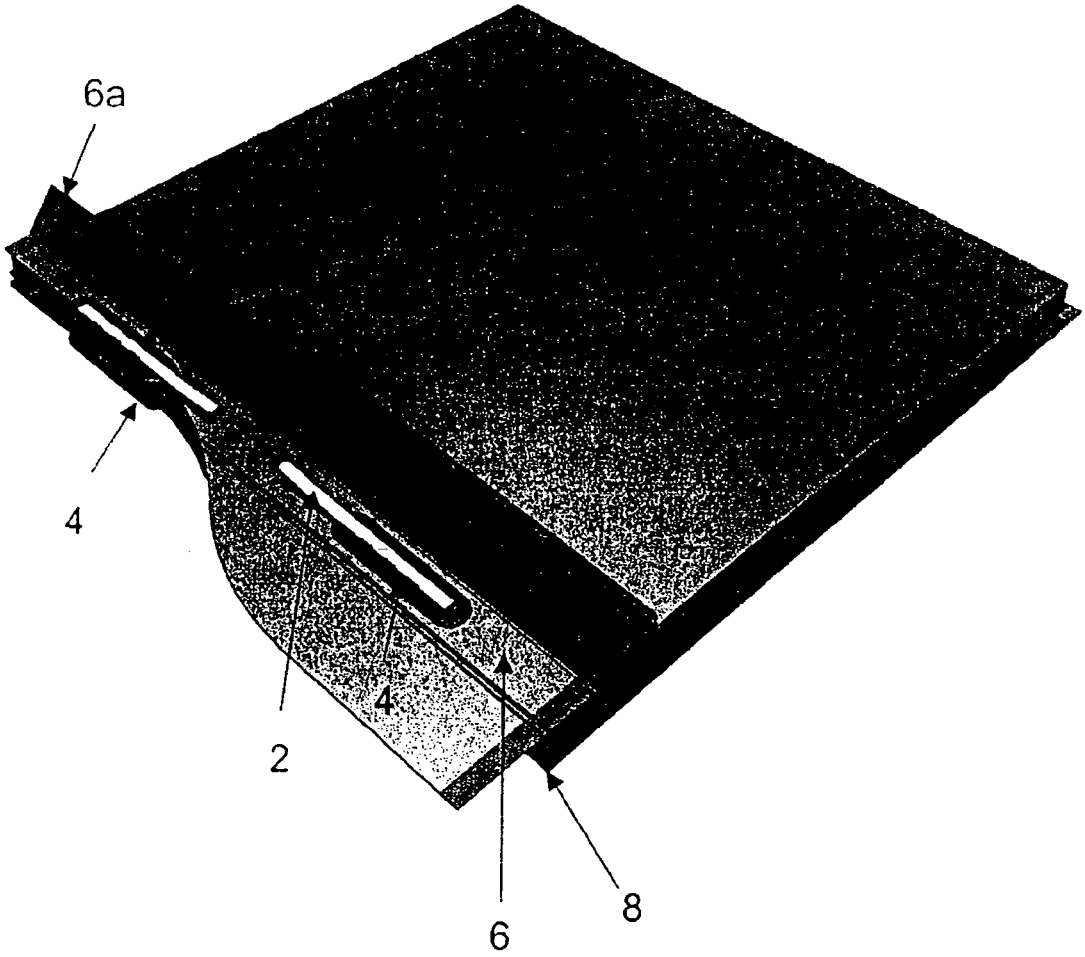
FIG. 1 is a perspective view showing an album having fasteners in accordance with a preferred embodiment of the invention with the front cover of the album being shown in an open condition to expose the fasteners, each fastener having a pair of identical strap anchors and a strap extending between the anchor.
Figure 2:
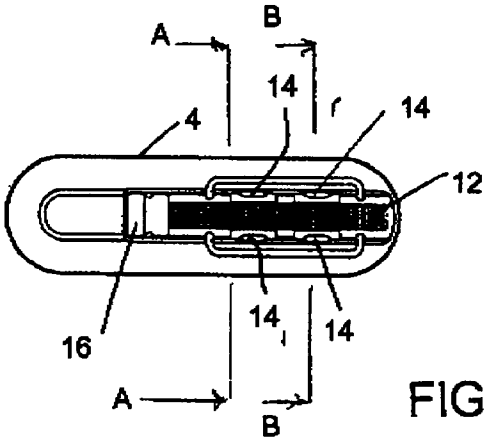
FIG. 2 is a plan view of the strap anchor of the fastener.
Figure 6:
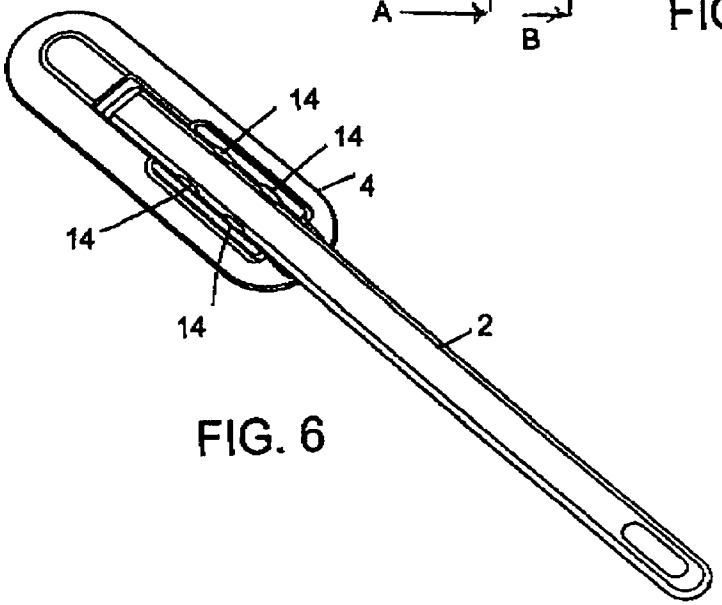
FIG. 6 is a perspective view showing the strap when locked to the anchor.
Figure 5:
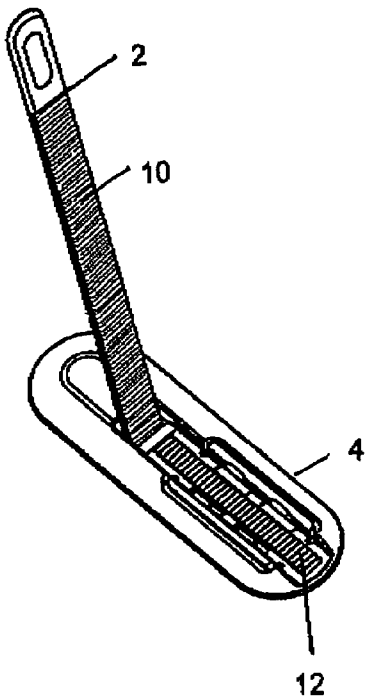
FIG. 5 is a perspective view showing the end portion of the strap projecting into the anchor via an aperture in its base and prior to locking of the strap to the anchor.
Figure 3:
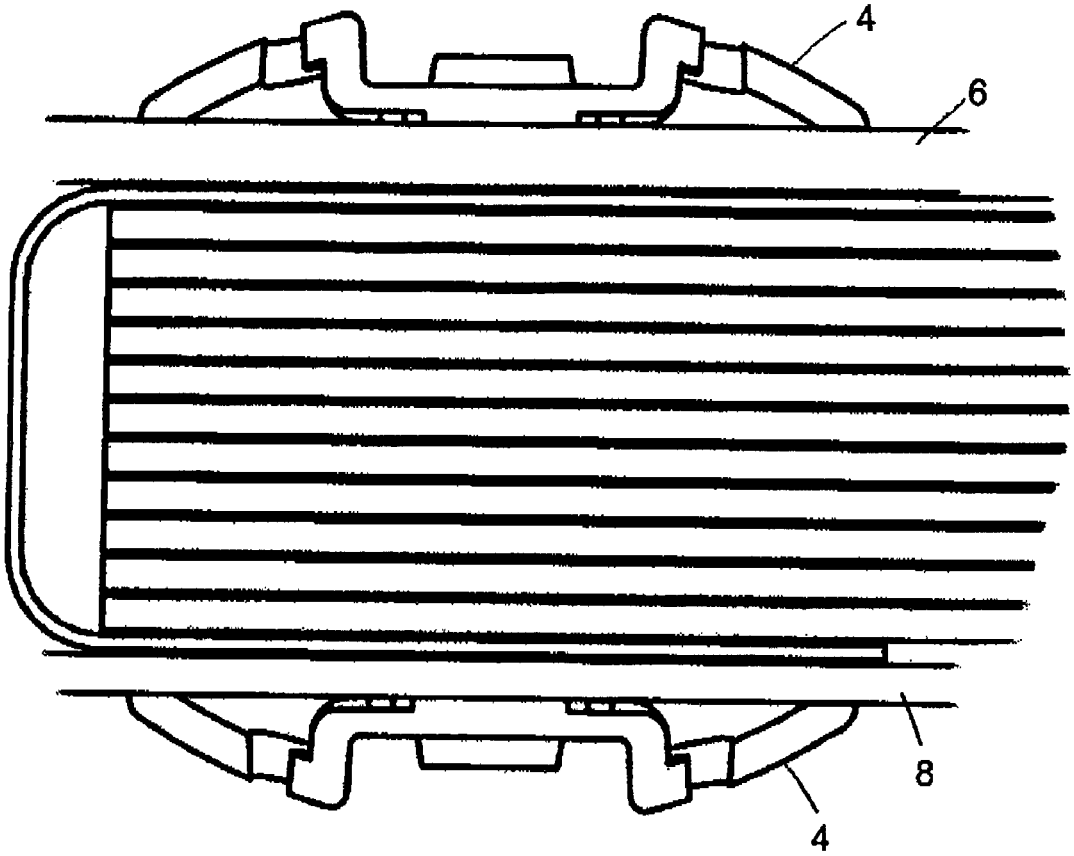
FIG. 3 is a transverse cross-section along line A-A of FIG. 2 and showing the pair of strap anchors of the fastener attached to the respective covers of the album, with the strap being omitted.
Figure 4:
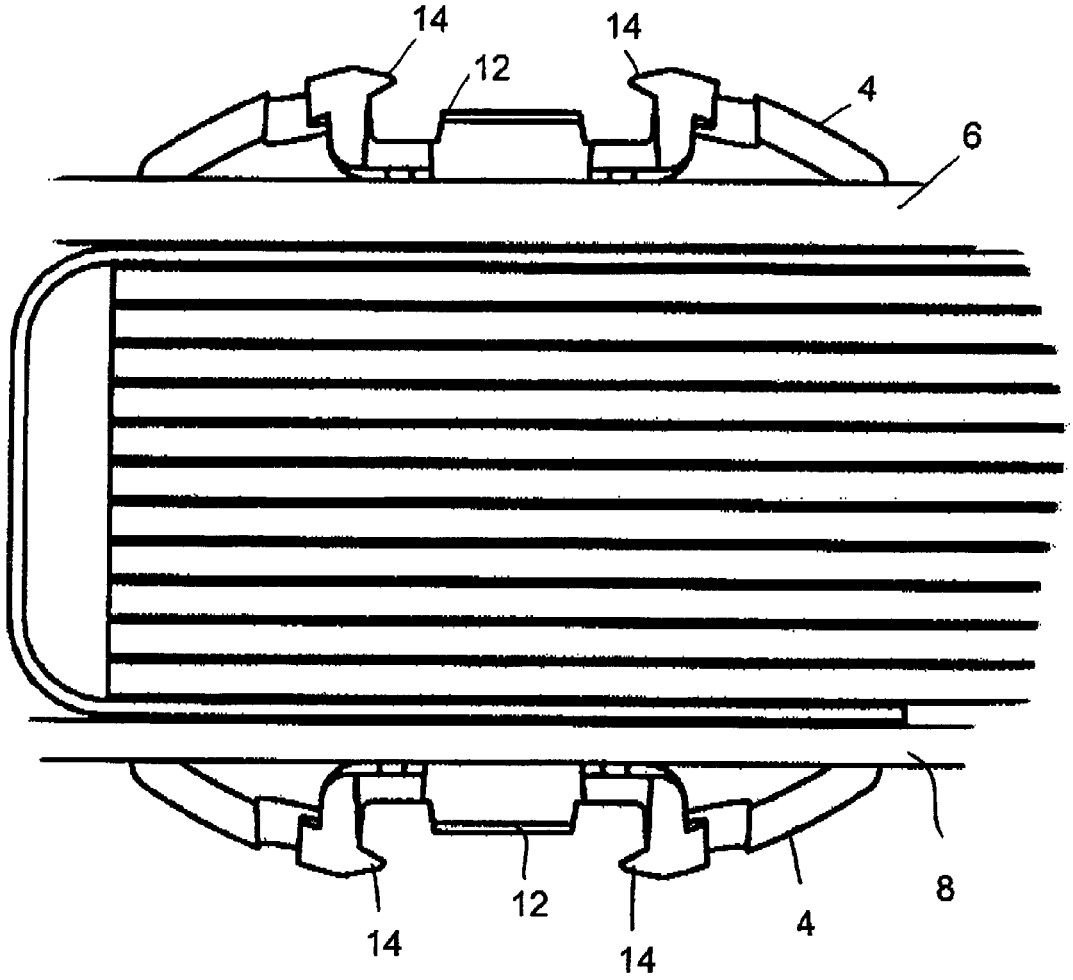
FIG. 4 is a cross-section similar to FIG. 3 but along line B-B of FIG. 2 to illustrate the form of the locking lips of the strap anchors.

An album fastener in accordance with a preferred embodiment of the invention comprises a strap 2 of variable length which passes through the album from the front to the back and a pair of identical strap anchors 4 mounted to external surfaces of the front and back covers 6,8. Usually, the album will be assembled using a pair of such fasteners spaced along the spine of the album and that is what is shown in FIG. 1. The strap 2 is of a semi-rigid plastics material formed on one surface with parallel ribs 10 which extend across the width of the strap 2. Each strap anchor 4 is in the form of a channel having on its base a corresponding array of transverse ribs 12 to engage with those of the strap 2 when the strap 2 is pressed into the channel to thereby anchor the strap 2 against longitudinal movement within the channel. The exposed end portion of the strap 2 is a snap lock into the channel by being pushed into the channel from its open side facing the base, the strap 2 locking beneath pairs of opposed locking lips 14 at opposite sides of the channel. As shown there are two such pairs of lips 14.

The strap 2 enters into the channel through an aperture 16 in the base of the channel adjacent one end and is then folded over and pressed into the channel to snap into engagement beneath the pairs of locking lips 14 which retain the ribs 10 in firm interlocking engagement with the ribs 12 at the base of the channel. The end of the strap 2 will project beyond the channel by a variable distance depending on the thickness of the album and can be easily be grasped to permit the strap to be disengaged from the channel by pulling the strap away from the base of the channel past the lips 14. In the embodiment described, the snap action to effect the engagement occurs by resilient deflection of the locking lips 14. In alternative forms however, this may be accompanied by resilient deflection also of the edge portions of the strap or even just the edge portions of the strap may resiliently deflect, with the locking lips being substantially rigid.

Figure 7:
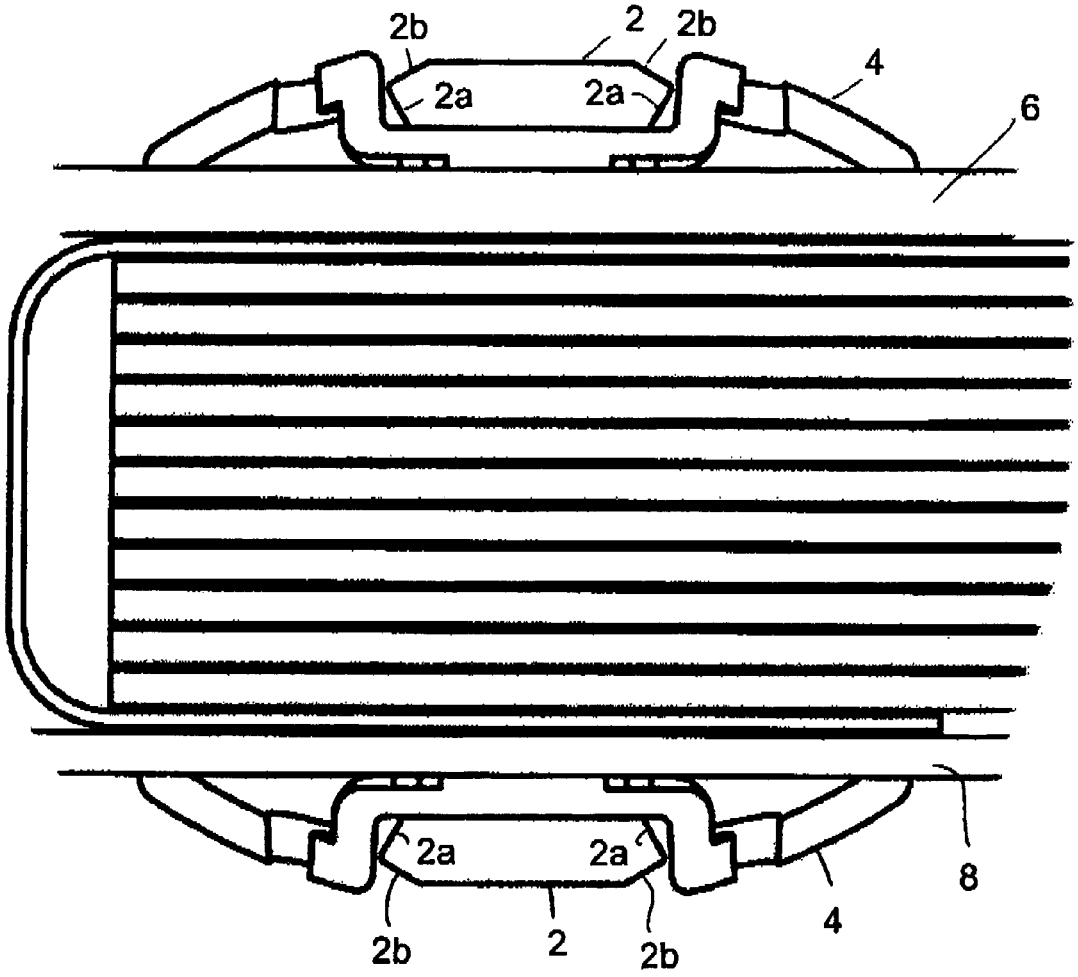
FIGS. 7 and 8 are cross-sections corresponding to FIGS. 3 and 4 respectively but showing the strap locked within the anchors.
Figure 8:
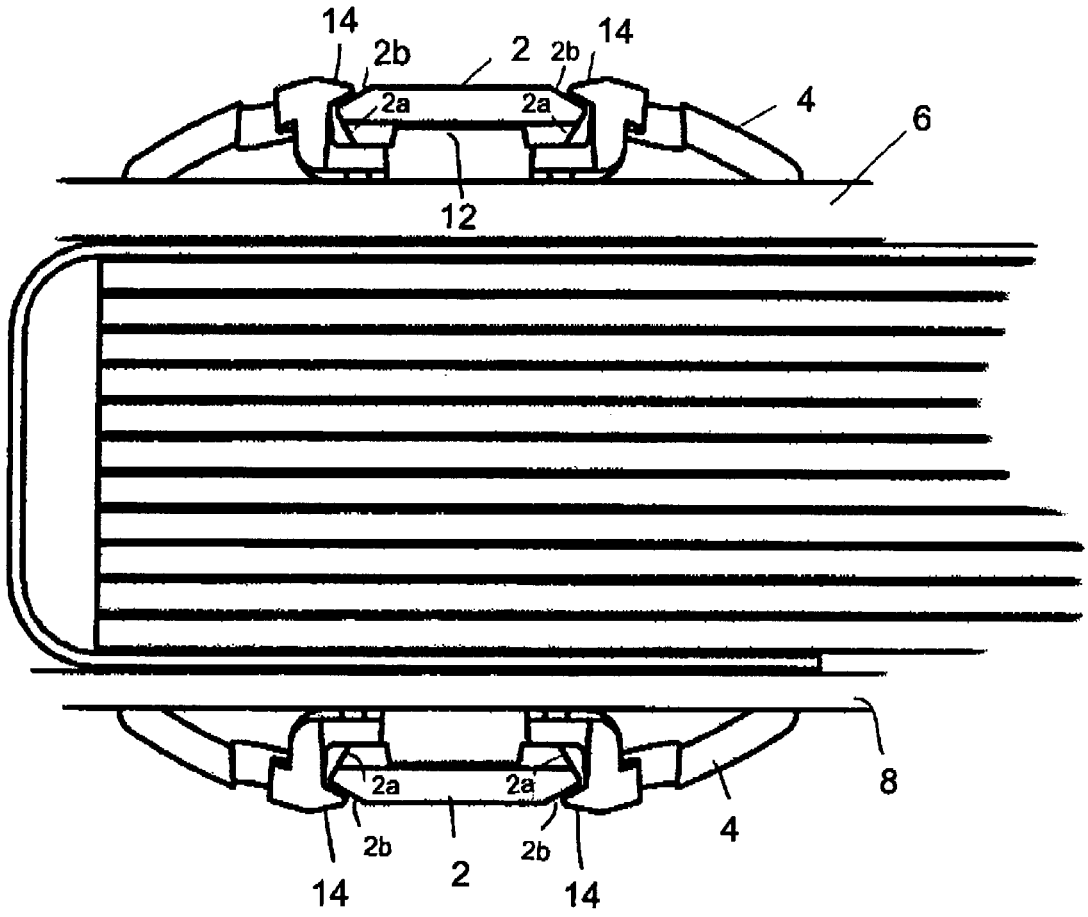

The cross-sectional profile of the strap 2 is designed to facilitate both its insertion into and its removal from the channel when required whilst also ensuring that a secure locking effect is provided. This cross-sectional profile is shown in FIGS. 7 and 8 from which it will be seen that each longitudinal edge of the strap is formed with an inner and outer pair of opposed chamfers 2*a*,2*b*. The inner chamfers 2*a* facilitate easy insertion into the channel and the outer chamfers 2*b* facilitate easy removal from the channel when required, the pairs of locking lips 14 engaging the outer chamfers 2*b* as clearly shown in FIG. 8.

Figure 9:
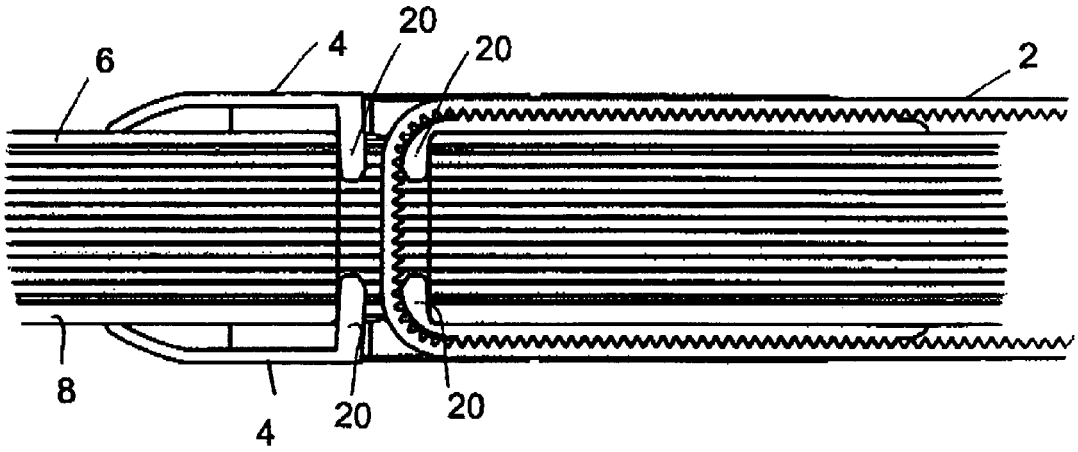
FIG. 9 is a longitudinal section through the spine of the album to show the pair of strap anchors and the strap locked thereto.

The strap anchors 4 are moulded in a suitable plastics material and can be attached to the front and back covers of the album by adhesive such as an adhesive tape, with the aperture 16 in the base of the channel being aligned with a hole in the adjacent cover 6 or 8 for passage of the strap 2 therethrough. Preferably, positive alignment is achieved between the aperture 16 and the hole in the adjacent cover by lugs 20 which project from the base of the channel at opposite sides of the aperture 16 to engage in the hole in the adjacent cover as shown in FIG. 9. The material of the strap 2 is such that although it has sufficient flexibility to enable its projecting end to be bent into the channel and to be deflected past the lips 4 to be retained thereby it also has sufficient rigidity to enable it to be easily inserted through the aligned holes in the covers and album pages therebetween. Insertion of the strap through the holes will, due to the rigidity of the strap, tend to cause the holes in the successive pages to move into required alignment if they are slightly misaligned.

The opposed end portions of the strap 2 will be attached to the strap anchors 4 on the front and back covers in the manner described, and the strap 2 is of a length to permit adjustment of the album by incorporating additional sets of album pages as required. As a releasable strap anchor 4 provided on the front and back cover, either end of the strap can be released as required.

The insertion of the straps through the sheets when adding or replacing sheets is significantly easier than insertion of the two-part fastening screws conventionally used and the straps also provide significantly greater versatility in increasing the size of the album as the only controlling factor of the thickness of the album is the length of the strap and that can be made in a length which can accommodate substantial thickness variation.

Due to the relatively simple nature of the fasteners, they can be produced inexpensively so that their overall cost can be maintained at level comparable with that of the conventional fastening screws. This is quite important because albums of this type do attend to be quite cost-sensitive and despite the improvements obtained in the functionality of the fastener, the album still needs to be available at a price equivalent to that of albums with conventional screw-type fasteners.

It will be noted from FIG. 1 that the strap anchors 4 are actually applied to what is an inside surface of the cover. In the secured configuration of the fastener, an inner extension flap of the cover shown at 6*a* in FIG. 1 is folded over to conceal the two strap anchors and straps. Only a small part of the front cover is actually shown in FIG. 1 and in FIG. 1 the front cover is depicted in its open condition; when closed, the main part of the front cover will be folded inwardly to overlie the extension 6*a*. This configuration of front cover, which is repeated also for the back cover, corresponds to that which is used in albums using conventional screw-type fasteners. However, as a consequence of this cover arrangement in which the outer parts of the fastener lie inwardly of the cover when in its closed position, these outer parts do need to be of a low profile so that they do not interfere with closure of the cover. The simple channel form of the described strap anchors with the snap-lock of the straps therein permits the requisite low profile to be achieved as the channel itself is of low profile, and the strap is retained within the depth dimension of the channel by the locking lips without the need for additional locking means projecting outwardly from the channel.

Figure 10:
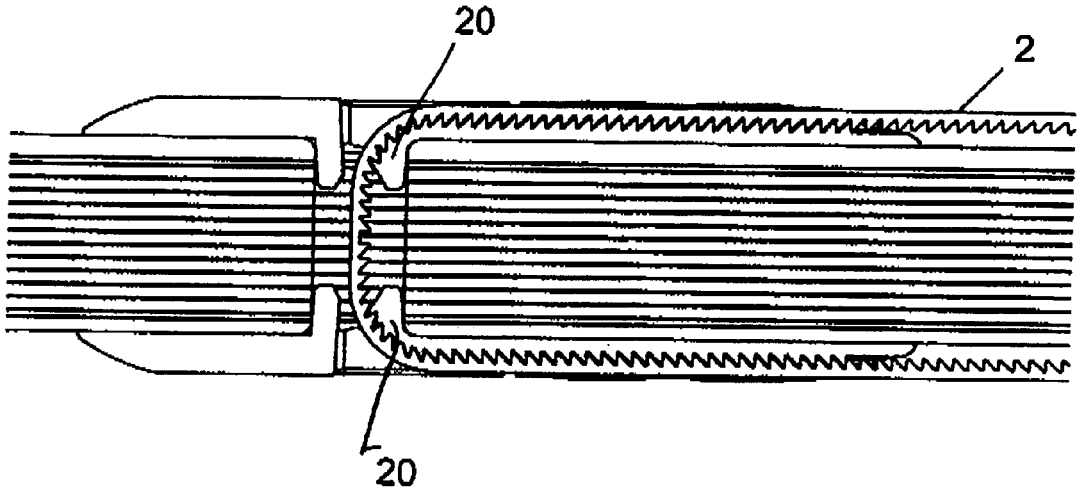
FIG. 10 is a longitudinal section similar to FIG. 9 and showing a modified embodiment.
Figure 11:
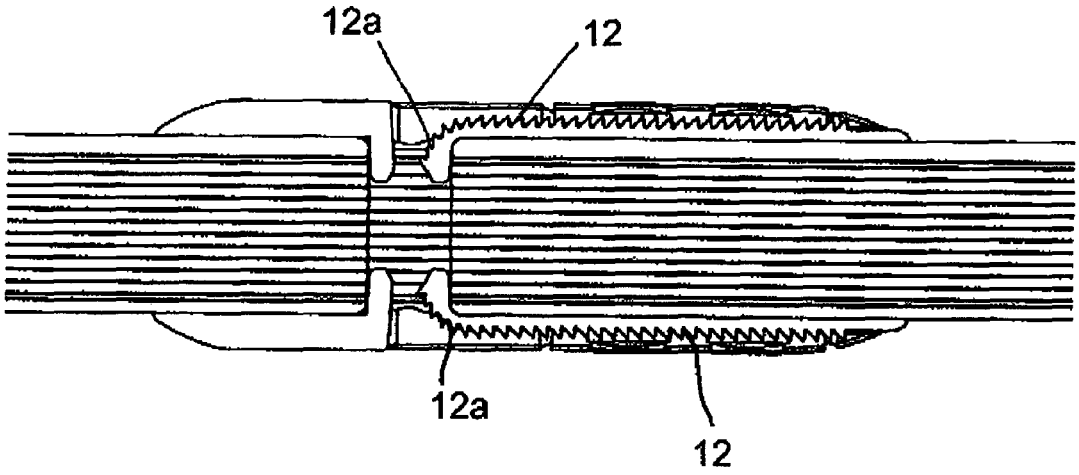
FIG. 11 is a longitudinal section corresponding to FIG. 10 but with the strap omitted.
Figure 12:
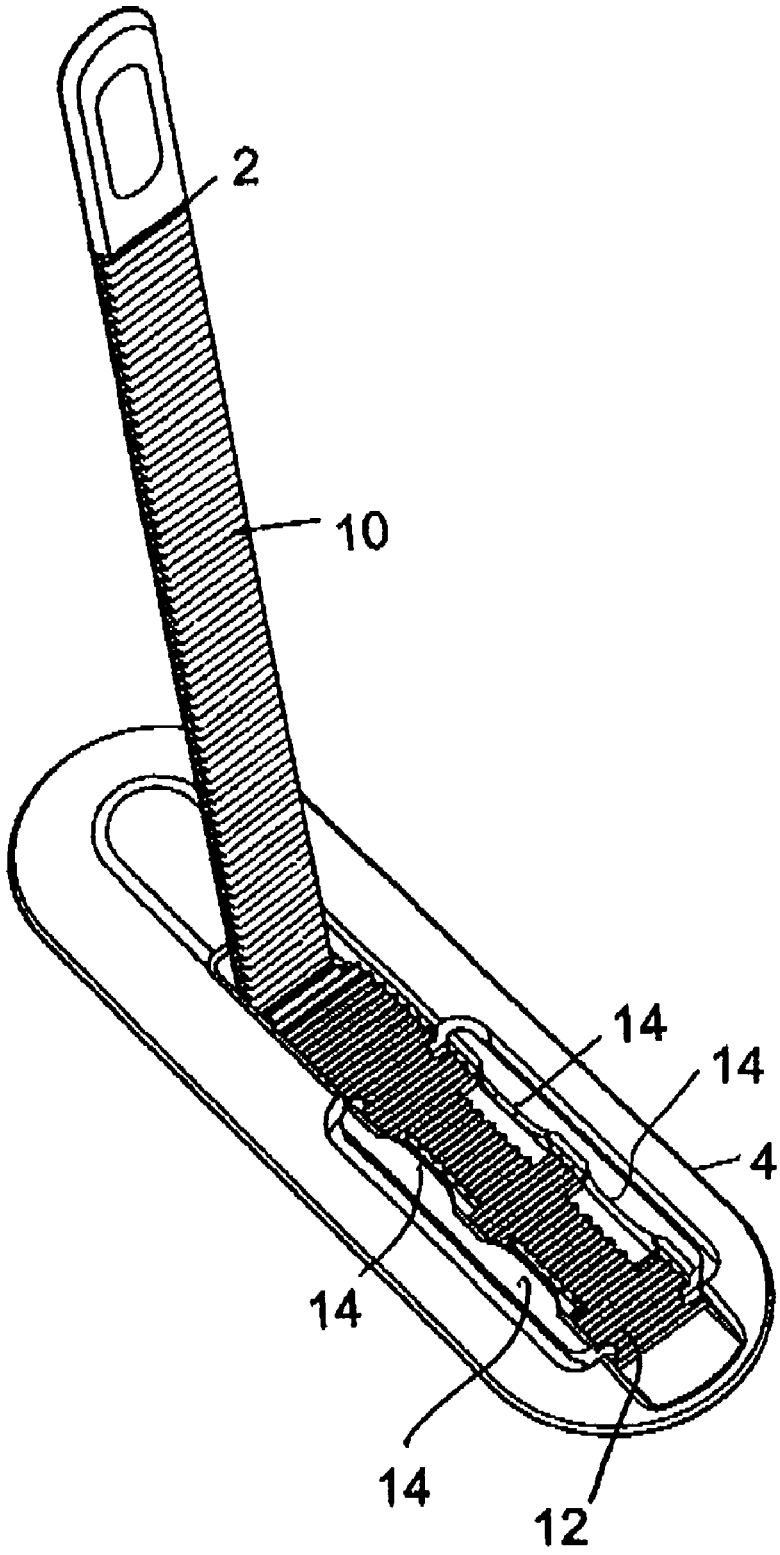
FIG. 12 is a perspective view similar to FIG. 5 but showing the modified embodiment.

In a modified embodiment of the invention as shown in FIGS. 10 to 12 the co-operating ribs 10 and 12 on the strap 2 and on the base of the channel 4 are of saw-tooth profile with the upright face of the profile orientated to prevent the strap 2 from being pulled through the channel 4 under the applied loading in the engaged condition of the strap. To ensure the required co-operation between the ribs 10 on the strap and the ribs 12 on the two identical strap anchors of the fastener, the orientation of the saw-tooth profile of the strap ribs is reversed midway along the length of the strap as is clearly shown in FIG. 10.

In order to further improve the fixing of the strap in the channel to prevent slipping, additional ribs are also formed on the surface of the adjacent lug 20 and around which the strap passes when entering the aperture 16. This is shown in FIG. 11 where the additional ribs are designated 12*a*.

In this modified embodiment, in order to further improve the contact area between the ribs 10 and 12, the ribs 12 have been extended in length to extend across the entire width of the channel 4 except in the zone of the lips 14 where they are of reduced width as a result of tooling considerations associated with the moulding of the lips. This is shown in FIG. 12.

The embodiments have been described by way of example only, and modifications are possible within the scope of the invention.

The invention claimed is:

1. A releasable fastener for an album comprising front and back covers and removable pages between the covers, the fastener having a pair of strap anchors, one adapted to be attached to the front cover and the other to the back cover, a strap adapted to pass through aligned apertures in the covers and album pages from the strap anchor at the front to the strap anchor at the back, and a releasable connection provided between the strap and each of the strap anchors to enable insertion and removal of pages at the front and back of the album, the releasable connection permitting adjustment of the effective length of the strap between the anchors to accommodate a variable thickness of the album, wherein each strap anchor is in the form of a channel in which the strap is snap-locked to be releasably locked therein against displacement by snapping engagement beneath locking lips at an open side of the channel facing the base of the channel, and the base of the channel and opposing surface of the strap have formations which are engaged to prevent longitudinal displacement of the strap within the channel when its in its engaged position beneath the lips.

2. A fastener according to claim 1, wherein the inter-engaging formations on the base of the channel and surface of the strap consist of closely-spaced lateral ribs.

3. A fastener according to claim 2, wherein the ribs are of saw-tooth profile in cross-section with an upright face of the profile orientated in a direction to prevent the strap from being pulled through the channel under the applied loading during use.

4. A fastener according to claim 1, wherein there are two or more opposed pairs of said locking lips arranged at spaced intervals along the channel.

5. A fastener according to claim 1, wherein the strap enters into the channel via an aperture in the base of the channel and that aperture is bordered by a projection adapted to extend into the adjacent aperture in the cover to ensure correct location between the strap anchor and the cover.

6. A fastener according to claim 5, wherein the projection is of rounded form around which the strap passes and the surface of the projection is provided with formations which engage with those on the strap to prevent longitudinal displacement of the strap along the projection.

7. An album comprising front and back covers and removable pages between the covers, and at least two releasable fasteners for maintaining the album in assembled, but easily disassemblable form, for insertion and removal of pages, the fasteners being spaced along the spine of the album, each fastener comprising:

a pair of strap anchors, one attached to the front cover and the other to the back cover;

a strap passing through aligned apertures in the covers and album pages from the strap anchor at the front cover to the strap anchor at the back cover; and a releasable connection provided between the strap and each of the strap anchors to enable insertion and removal of pages, the releasable connection permitting adjustment of the effective length of the strap between the strap anchors to accommodate a variable thickness of the album, wherein each strap anchor is in the form of a channel in which the strap is snap-locked to be releasably locked therein against displacement by snapping engagement beneath locking lips at an open side of the channel facing the base of the channel, and the base of the channel and opposing surface of the strap have formations which are engaged to prevent longitudinal displacement of the strap within the channel when its in its engaged position beneath the lips.

8. An album according to claim 7, wherein the inter-engaging formations on the base of the channel and surface of the strap consist of closely-spaced lateral ribs.

9. An album according to claim 8, wherein the ribs are of saw-tooth profile, with an upright face of the profile orientated in a direction to prevent the strap from being pulled through the channel under the applied loading during use.

10. A fastener according to claim 8, wherein there are two or more opposed pairs of said locking lips arranged at spaced intervals along the channel.

11. A fastener according to claim 8, wherein the strap enters into the channel via an aperture in the base of the channel and that aperture is bordered by a projection adapted to extend into the adjacent aperture in the cover to ensure correct location between the strap anchor and the cover.

12. A fastener according to claim 11, wherein the projection is of rounded form around which the strap passes and the surface of the projection is provided with formations which engage with those on the strap to prevent longitudinal displacement of the strap along the projection.

13. An album according to claim 7, wherein the strap anchors are adhesively attached to the respective covers.

14. A releasable fastener for an album to permit insertion and removal of pages between the front and rear covers of the albums, the fastener having a pair of strap anchors each attached to one of the two covers, and an adjustable strap passing between the anchors via aligned apertures in the covers and album pages, wherein each strap anchor is in the form of a channel in which the strap is snap locked by snapping engagement beneath locking lips at an open side of the channel facing the base of the channel and each of the longitudinal edges of the strap is formed with a pair of opposed chamfers which respectively facilitate insertion of the strap into the and out of the channel by deflection past the lip so that the strap is releasably but adjustably locked into the channel and is restrained from longitudinal displacement by inter-engaging formations on the base of the channel and the opposing surface of the strap, the channel being of low profile and the strap being retained within the depth dimension of the channel.

* * * * *